US012012671B2

(12) United States Patent
Hosotani et al.

(10) Patent No.: US 12,012,671 B2
(45) Date of Patent: Jun. 18, 2024

(54) METHOD FOR PRODUCING FLAME-PROOF FIBER BUNDLE, AND METHOD FOR PRODUCING CARBON FIBER BUNDLE

(71) Applicant: Toray Industries, Inc., Tokyo (JP)

(72) Inventors: Naoto Hosotani, Otsu (JP); Taku Yamamoto, Otsu (JP); Kazuyuki Gondo, Otsu (JP); Kohei Takamatsu, Ehime (JP); Yusuke Kuji, Ehime (JP)

(73) Assignee: Toray Industries, Inc., Tokyo (JP)

( * ) Notice: Subject to any disclaimer, the term of this patent is extended or adjusted under 35 U.S.C. 154(b) by 394 days.

(21) Appl. No.: 17/290,348

(22) PCT Filed: Nov. 6, 2019

(86) PCT No.: PCT/JP2019/043415
§ 371 (c)(1),
(2) Date: Apr. 30, 2021

(87) PCT Pub. No.: WO2020/110632
PCT Pub. Date: Jun. 4, 2020

(65) Prior Publication Data

US 2021/0310158 A1 Oct. 7, 2021

(30) Foreign Application Priority Data

Nov. 26, 2018 (JP) ..... 2018-220034

(51) Int. Cl.
*D01F 9/10* (2006.01)
*D01F 9/22* (2006.01)
*D01F 9/32* (2006.01)

(52) U.S. Cl.
CPC ..... *D01F 9/225* (2013.01); *D01F 9/328* (2013.01)

(58) Field of Classification Search
CPC .. D01F 9/22; D01F 9/225; D02J 13/00; D02J 13/001; D02J 13/005
See application file for complete search history.

(56) References Cited

U.S. PATENT DOCUMENTS 6,776,611 B1 * 8/2004 Sprague ..... D01F 9/32 432/64
7,004,753 B2 * 2/2006 Stockhausen ..... D01F 9/32 34/643
8,502,167 B2 8/2013 Colvin et al.

FOREIGN PATENT DOCUMENTS

JP 10266023 A 10/1998
JP 1161574 A 3/1999
(Continued)

OTHER PUBLICATIONS

International Search Report and Written Opinion for International Application No. PCT/JP2019/043415, dated Dec. 24, 2019, 5 pages.

*Primary Examiner* — Thu Khanh T. Nguyen
(74) *Attorney, Agent, or Firm* — BUCHANAN INGERSOLL & ROONEY PC

(57) ABSTRACT

A method of manufacturing a stabilized fiber bundle is described, which includes subjecting an acrylic fiber bundle aligned, to a heat treatment in an oxidizing atmosphere, with the acrylic fiber bundle being turned around by a guide roller placed on each of both ends outside a hot air heating-type oxidation oven, wherein an air velocity Vm of first hot air sent through a supply nozzle(s) disposed above and/or under a fiber bundle travelled in the oxidation oven, in a substantially horizontal direction to a travelling direction of the fiber bundle, and an air velocity Vf of second hot air flowing in a fiber bundle passing a flow channel in which the fiber bundle is travelled that satisfies expression 1)

$$0.2 \leq Vf/Vm \leq 2.0 \quad 1)$$

(Continued)

to produce a high-quality stabilized fiber bundle and a high-quality carbon fiber bundle at high efficiencies without any process troubles.

7 Claims, 12 Drawing Sheets

(56) References Cited

FOREIGN PATENT DOCUMENTS

| | | | | |
|---|---|---|---|---|
| JP | 2000160435 | A | | 6/2000 |
| JP | 2001-279536 | | * | 10/2001 |
| JP | 2002105766 | A | | 4/2002 |
| JP | 2004052128 | A | | 2/2004 |
| JP | 2007-162144 | | * | 6/2007 |
| JP | 4017772 | B2 | * | 12/2007 |
| JP | 2011127264 | A | | 6/2011 |
| JP | 2013242331 | A | | 12/2013 |

* cited by examiner

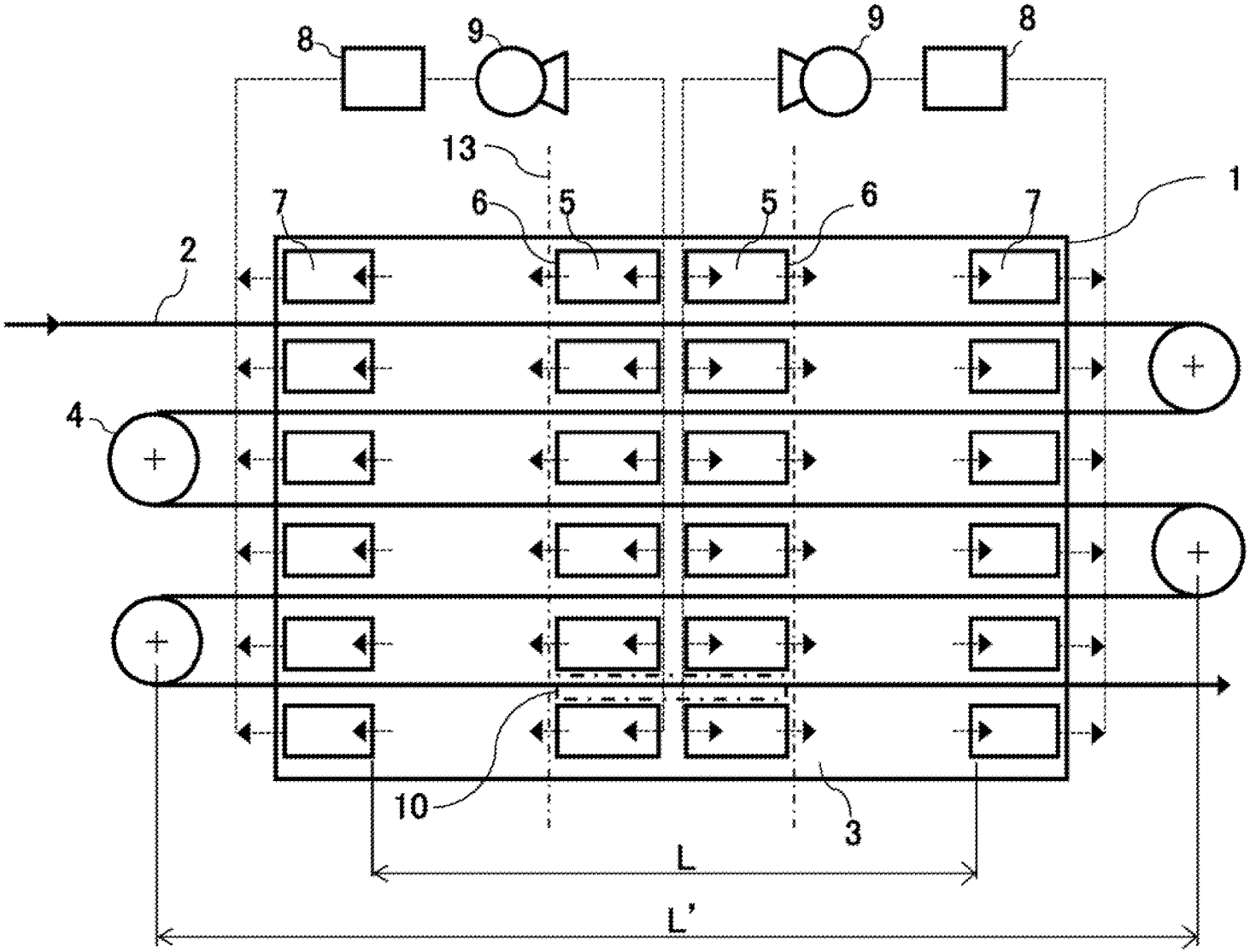
[Fig. 1]

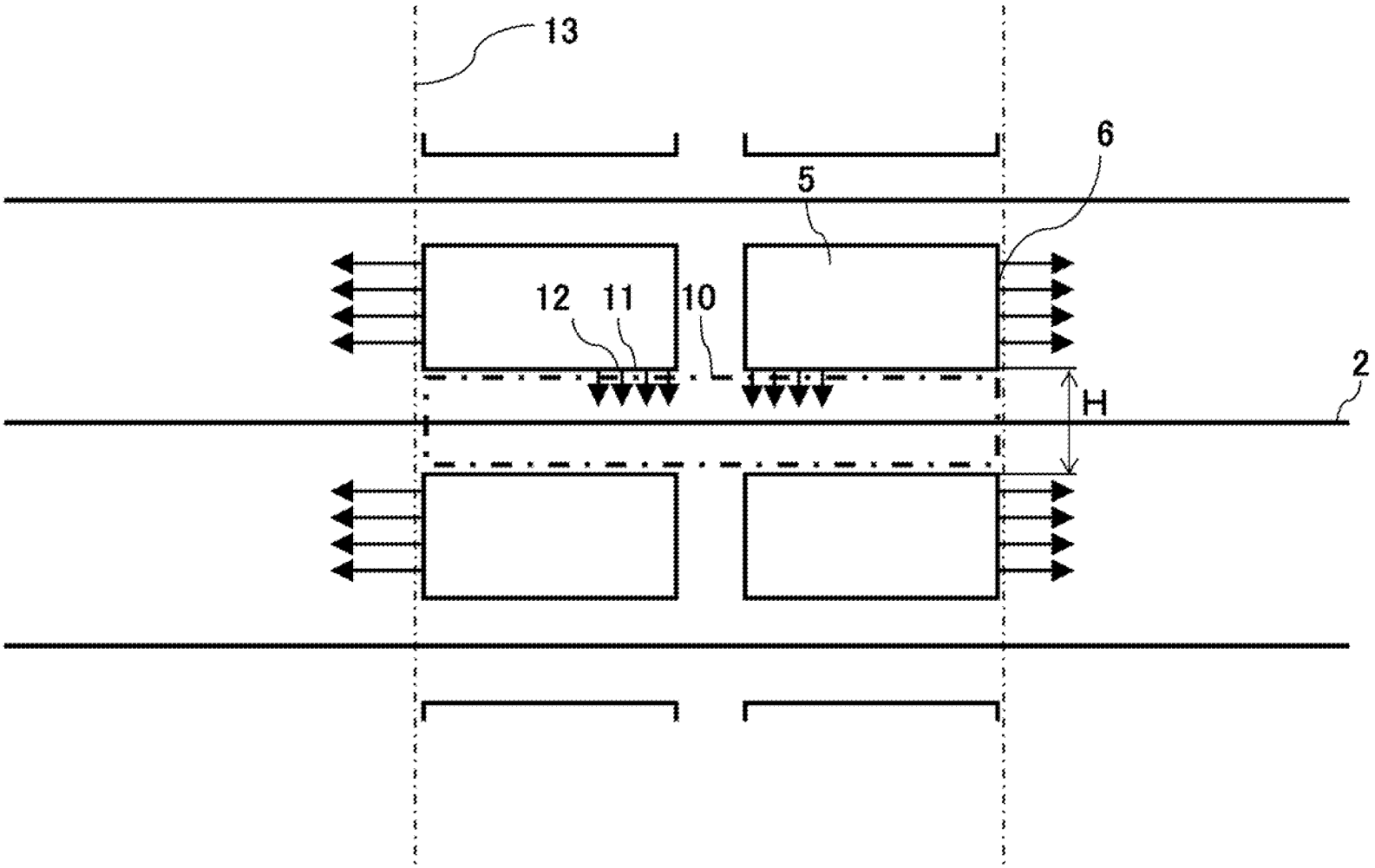
[Fig. 2]

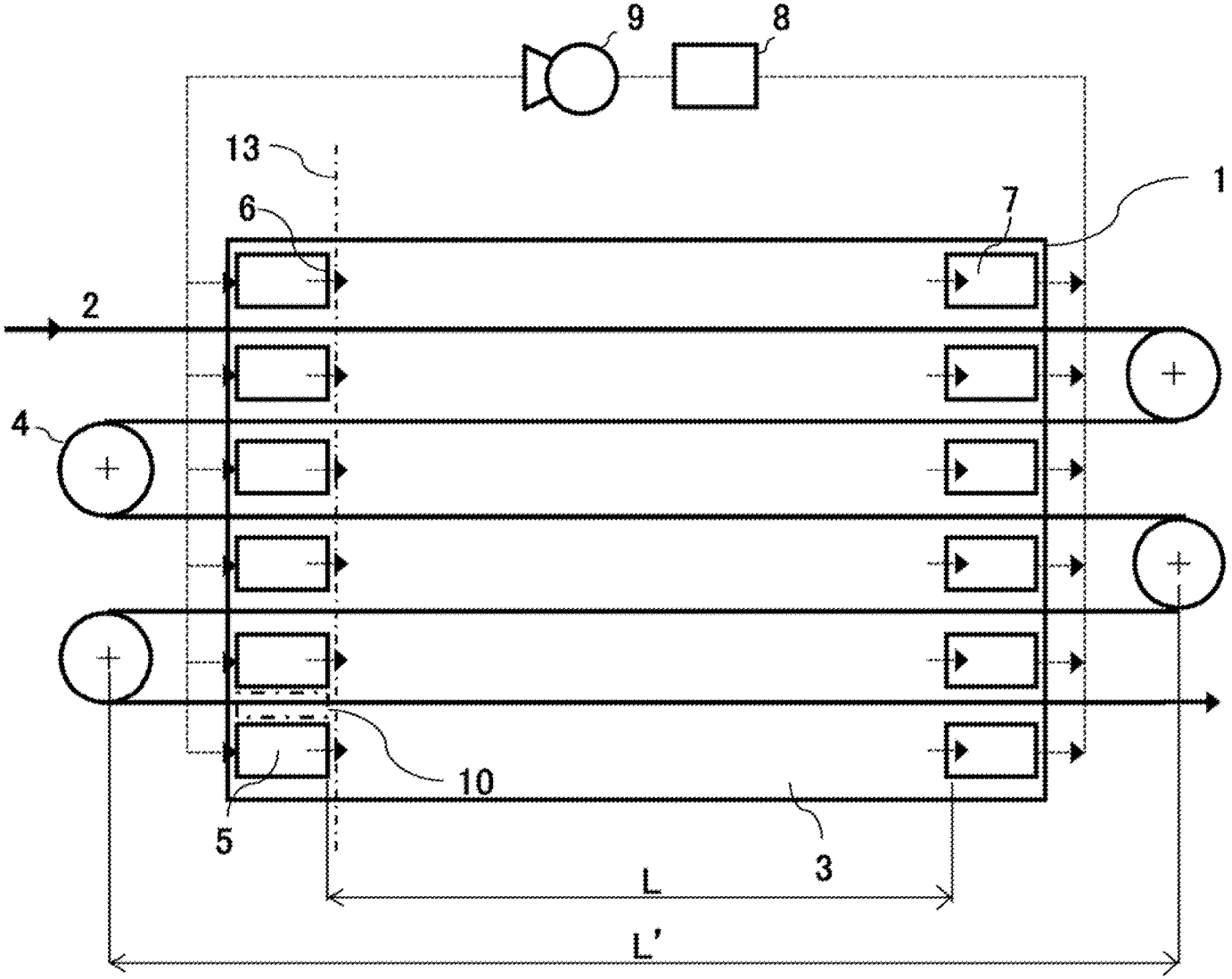
[Fig. 3]

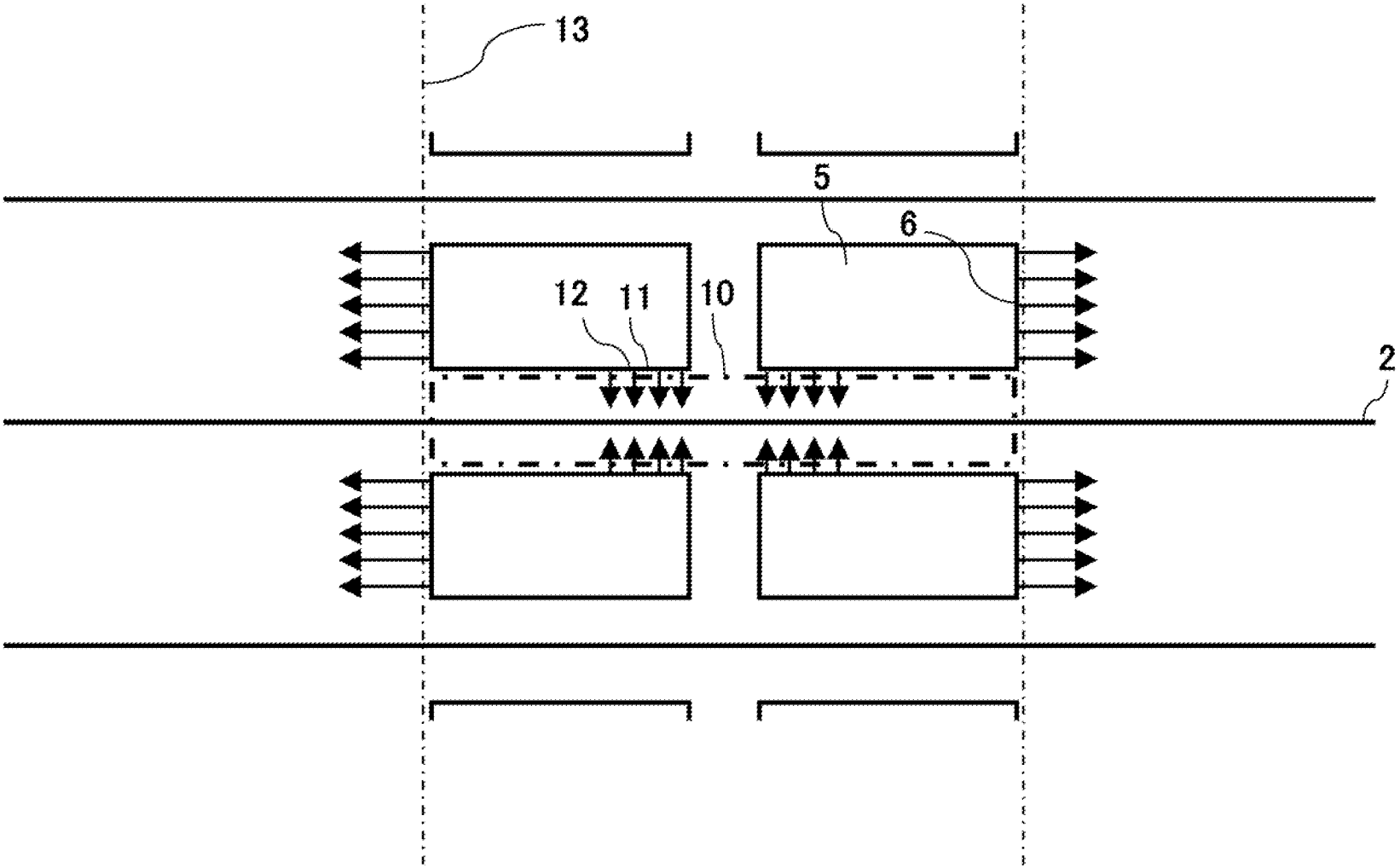
[Fig. 4]

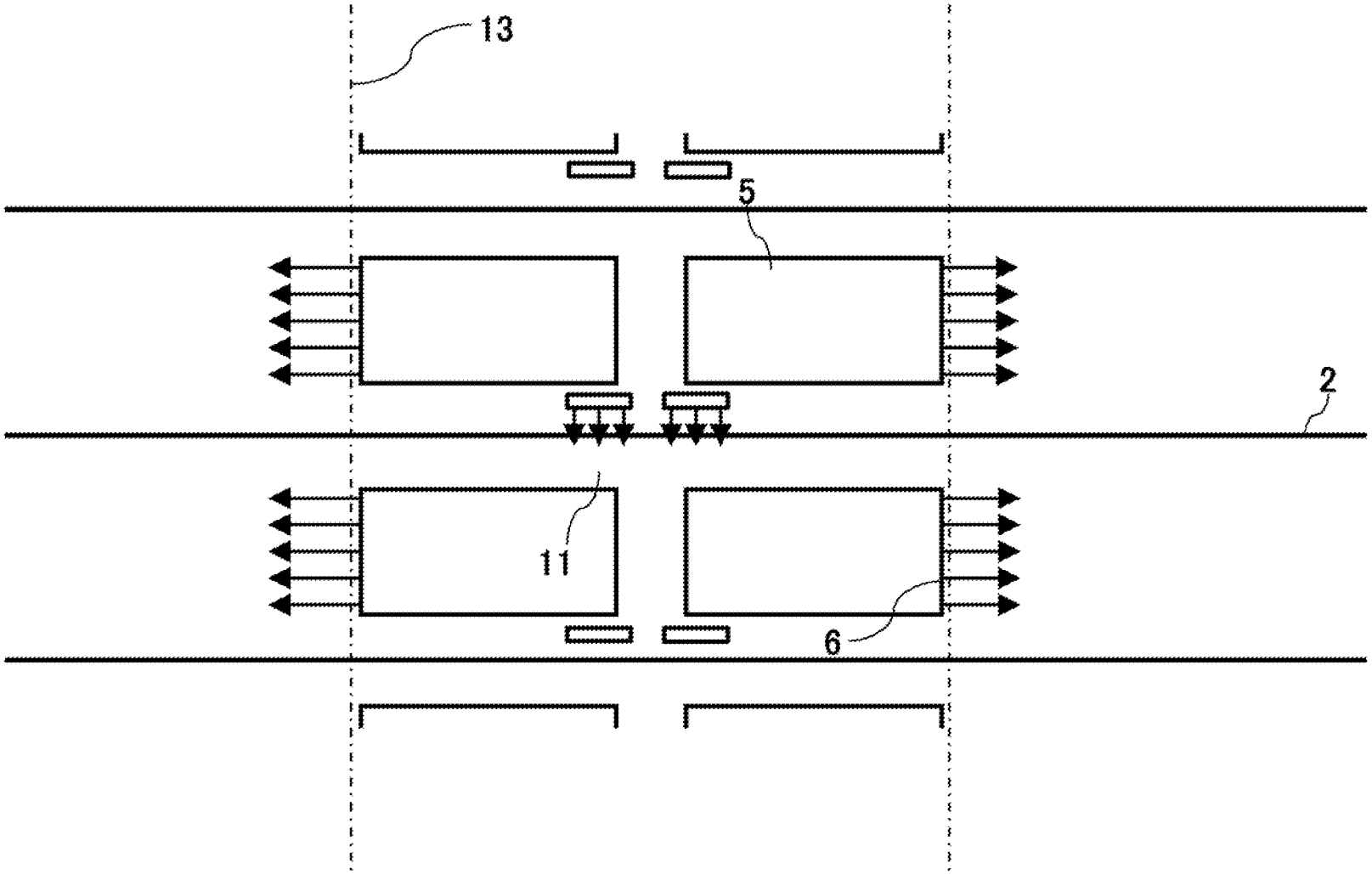
[Fig. 5]

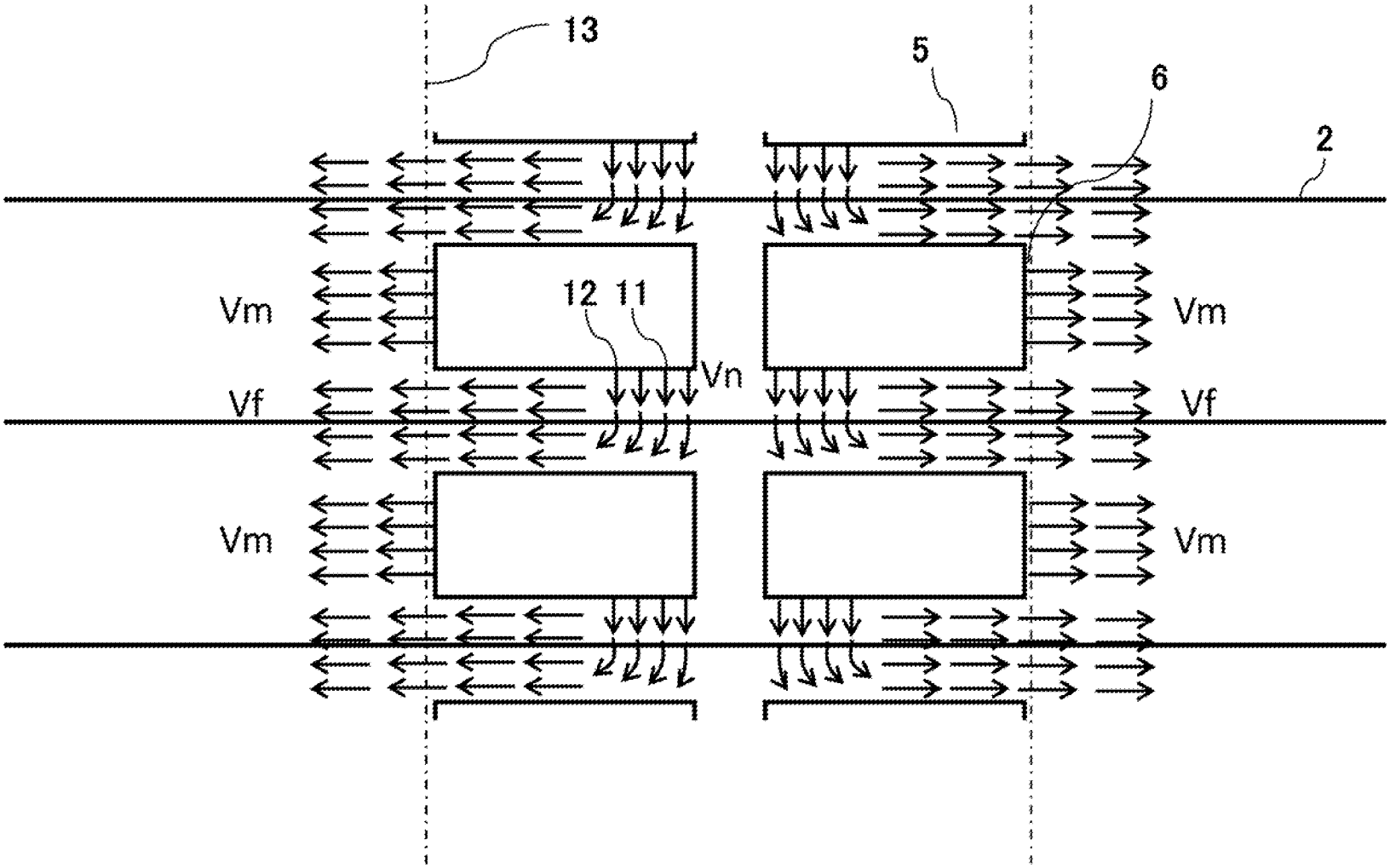
[Fig. 6]

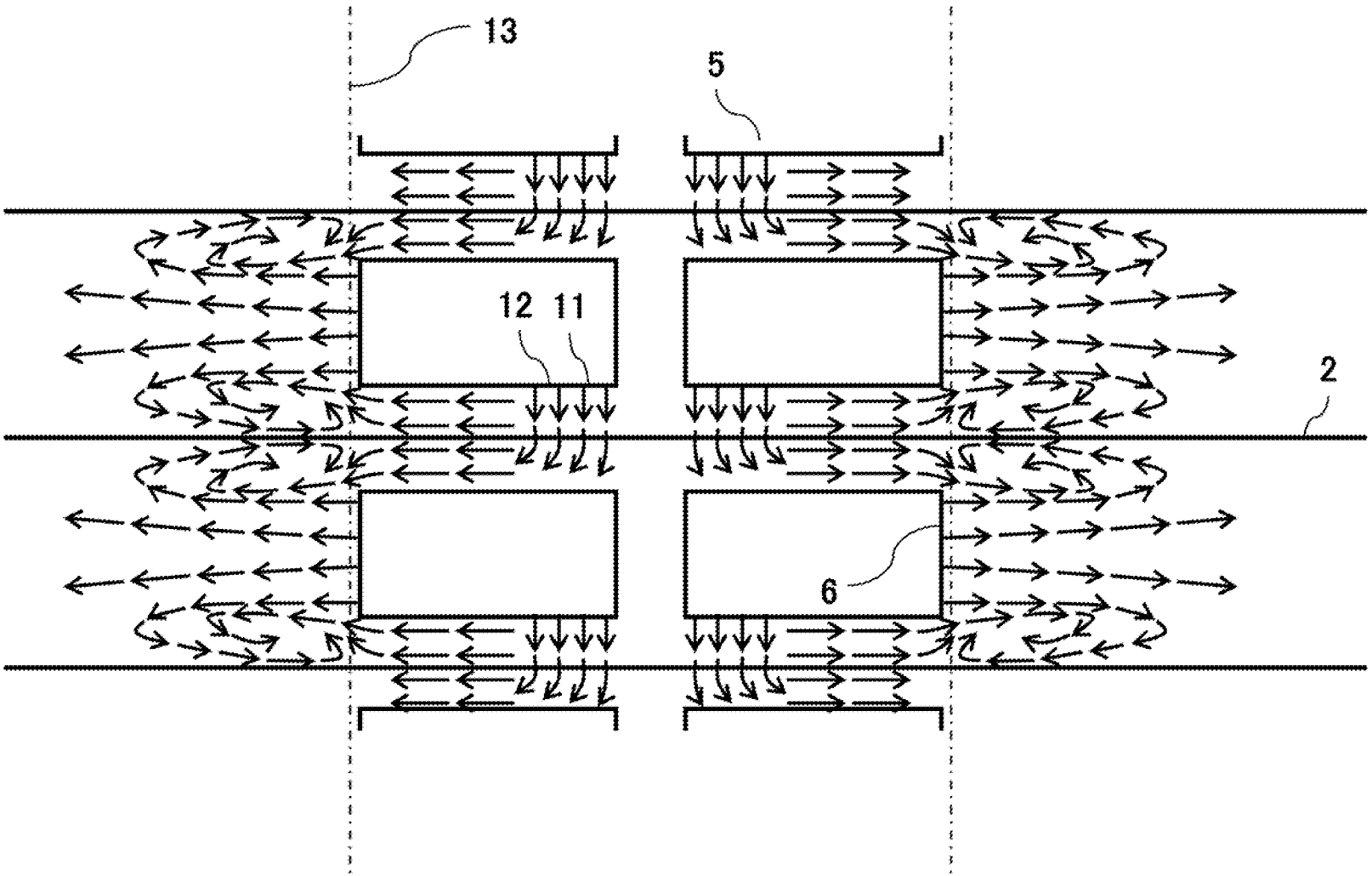
[Fig. 7]

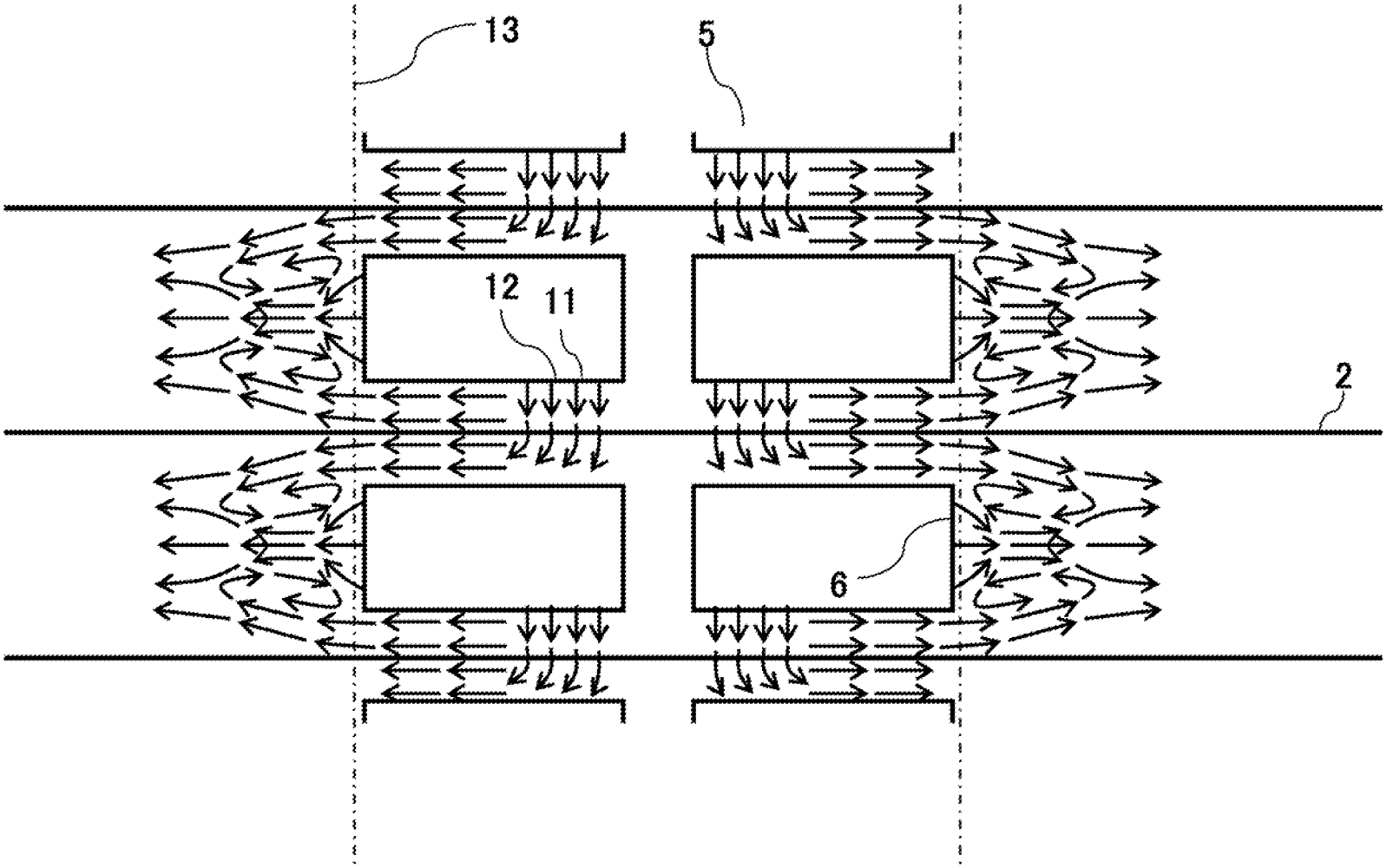
[Fig. 8]

[Fig. 9]
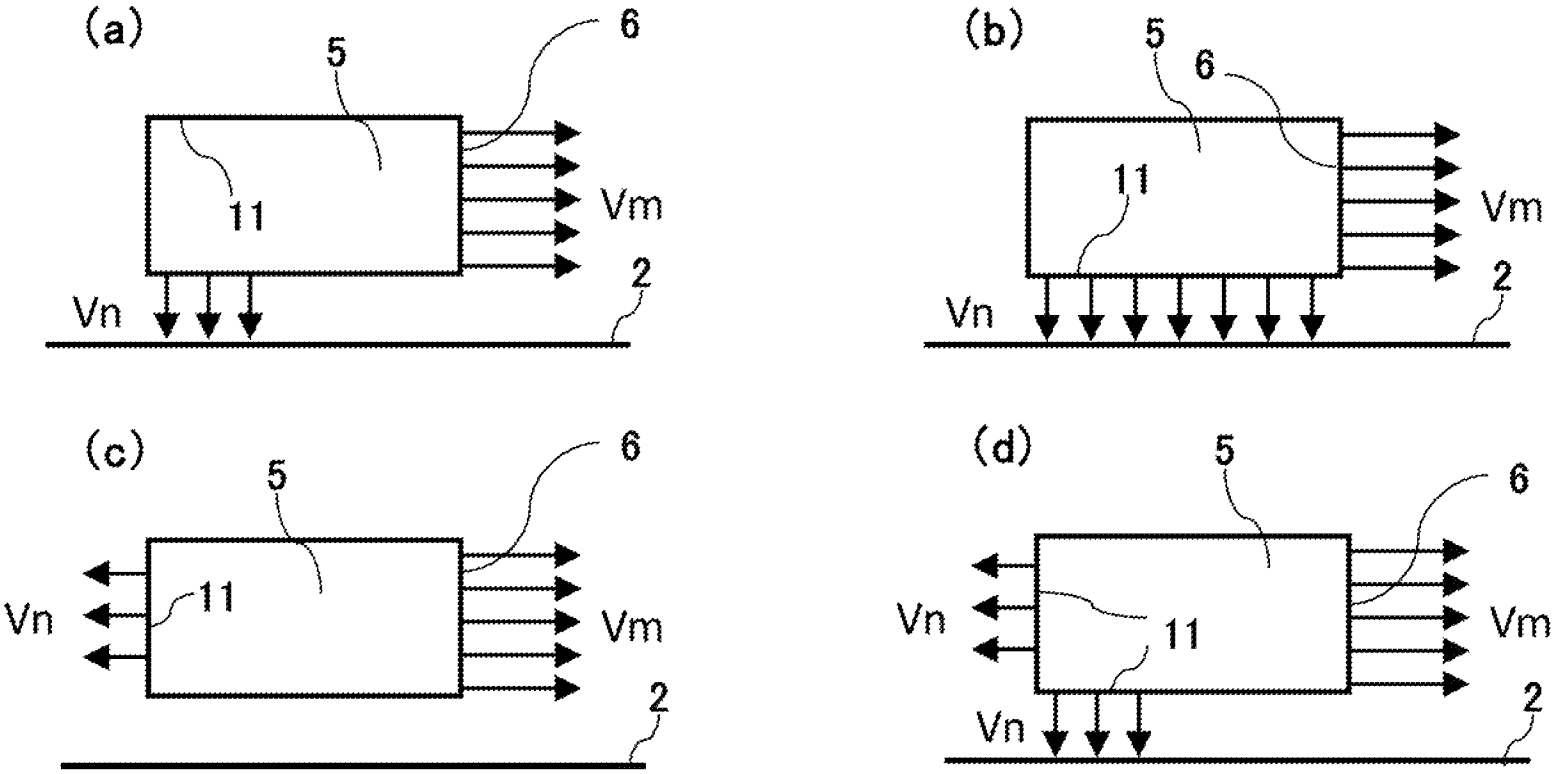

[Fig. 10]
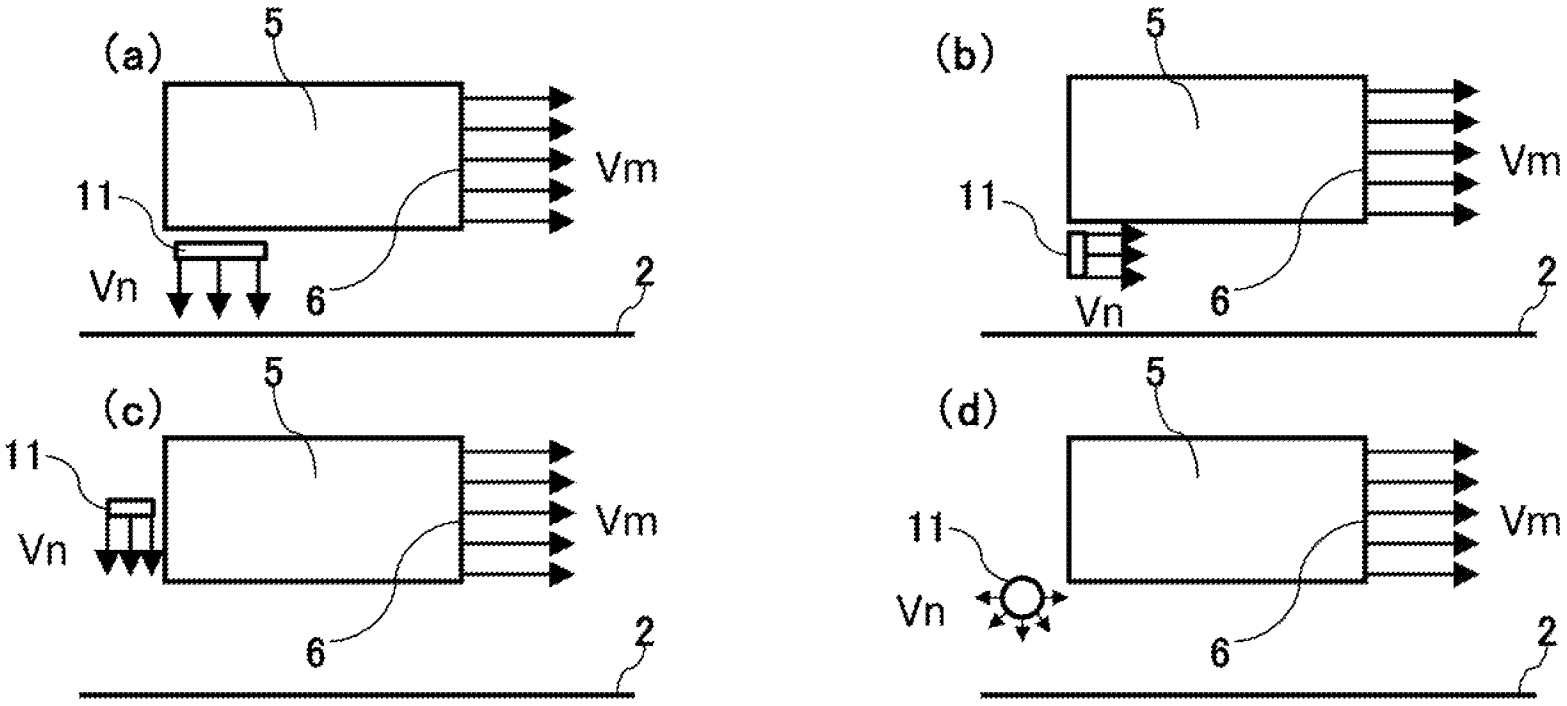

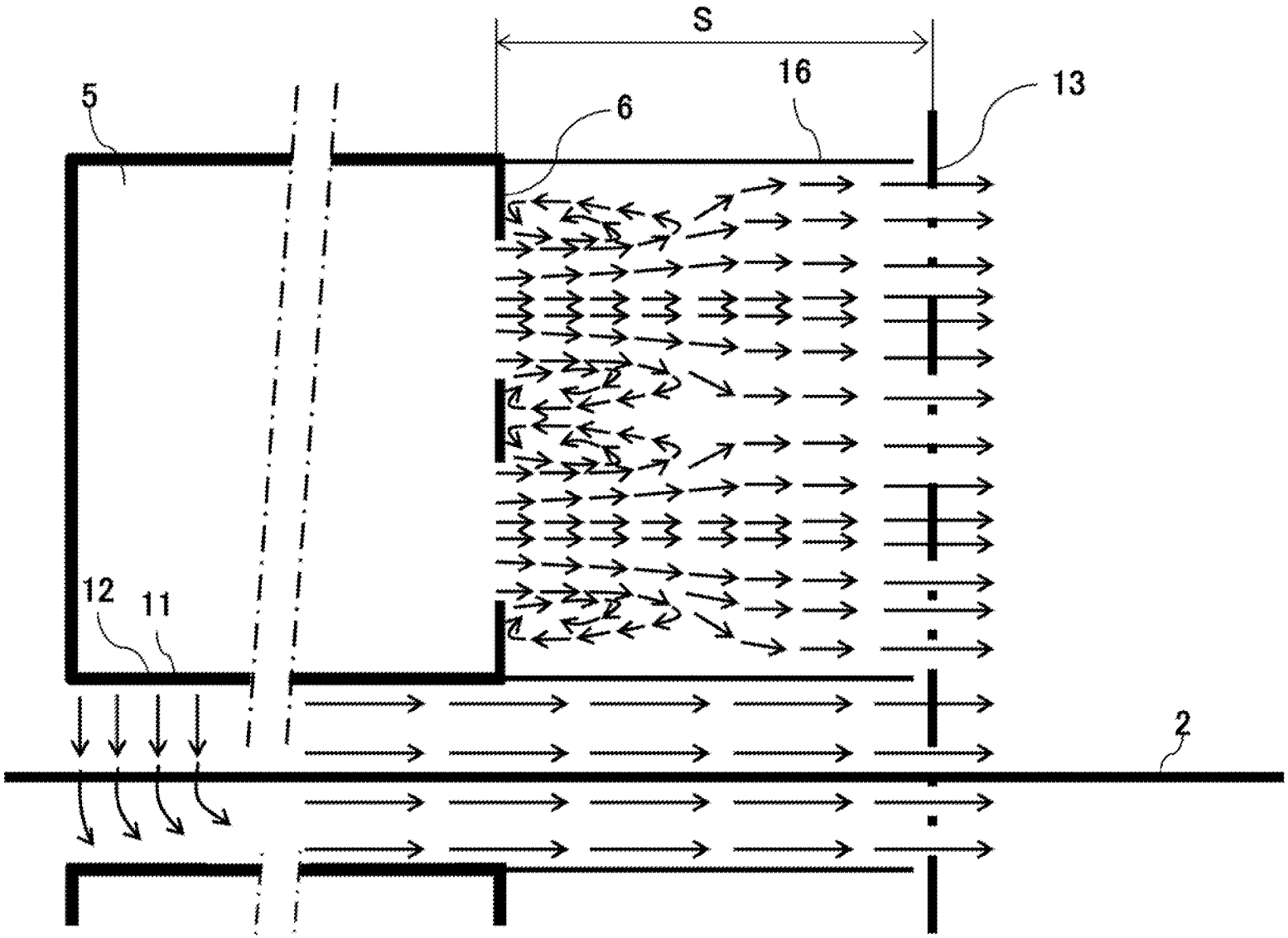
[Fig. 11]

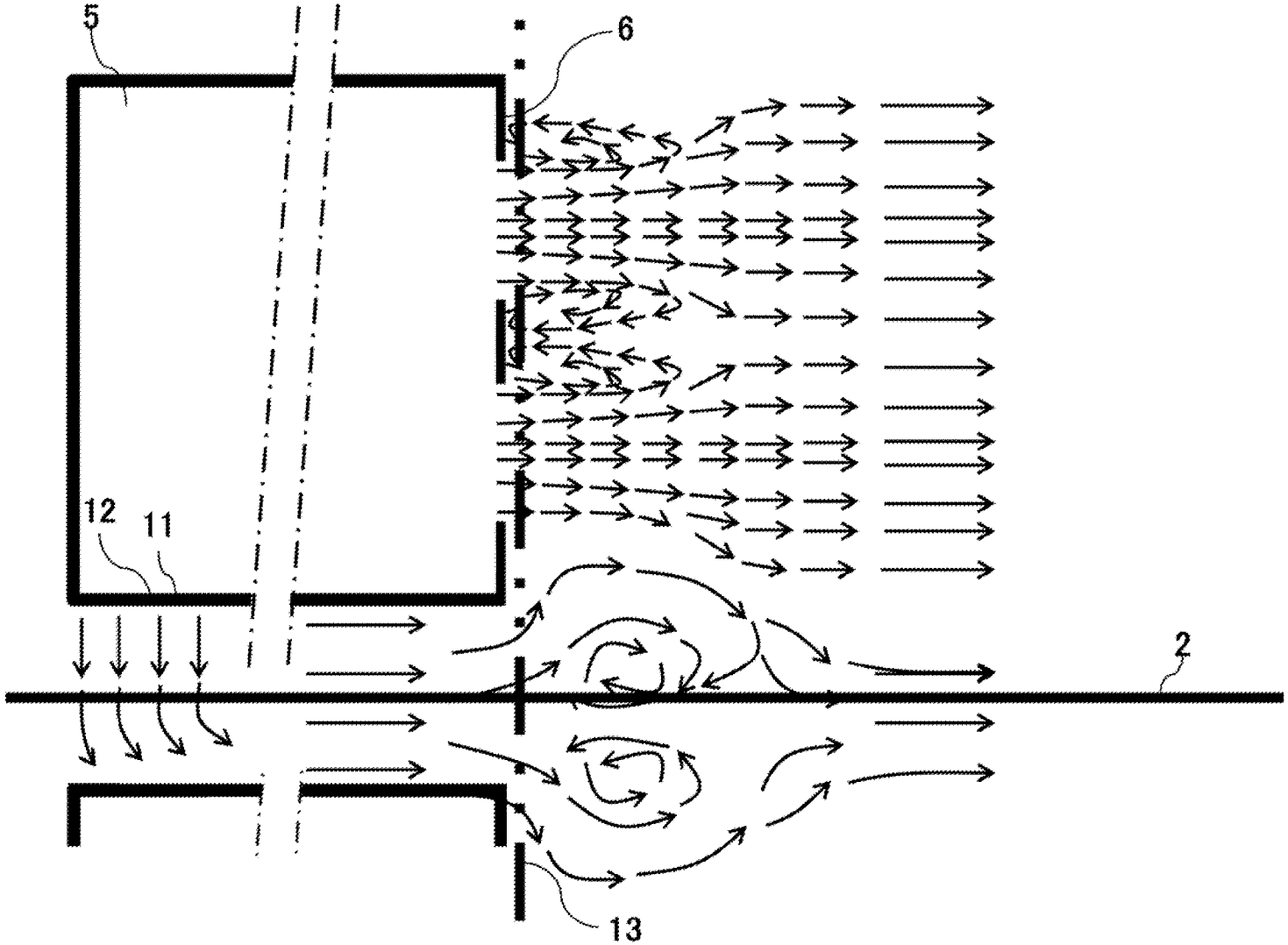
[Fig. 12]

METHOD FOR PRODUCING FLAME-PROOF FIBER BUNDLE, AND METHOD FOR PRODUCING CARBON FIBER BUNDLE

CROSS REFERENCE TO RELATED APPLICATIONS

This is the U.S. National Phase application of PCT/JP2019/043415, filed Nov. 6, 2019, which claims priority to Japanese Patent Application No. 2018-220034, filed Nov. 26, 2018, the disclosures of these applications being incorporated herein by reference in their entireties for all purposes.

FIELD OF THE INVENTION

The present invention relates to a method of manufacturing a stabilized fiber bundle and a method of manufacturing a carbon fiber bundle. More specifically, it relates to a method of manufacturing a stabilized fiber bundle and a method of manufacturing a carbon fiber bundle, which can produce a high-quality stabilized fiber bundle at a high efficiency without any process troubles.

BACKGROUND OF THE INVENTION

Carbon fibers are excellent in specific strength, specific tensile modulus, heat resistance, and chemical resistance, and thus are useful as reinforcing materials of various materials and are used in a wide variety of fields such as aerospace applications, leisure applications, and general industrial applications.

A commonly known method of manufacturing a carbon fiber bundle from an acrylic fiber bundle is a method involving sending a fiber bundle of several thousands to several tens of thousands of acrylic polymer single fibers bundled, to an oxidation oven, exposing the fiber bundle to hot air in an oxidizing atmosphere, for example, air supplied from a hot air supply nozzle placed in the oxidation oven and heated to 200 to 300° C., thereby subjecting the fiber bundle to a heating treatment (stabilization treatment), and thereafter sending the resulting stabilized fiber bundle into a carbonization furnace and subjecting the fiber bundle to a heating treatment (precarbonization treatment) in an inert gas atmosphere at 300 to 1,000° C. and then furthermore a heating treatment (carbonization treatment) in a carbonization furnace filled with an inert gas atmosphere at 1,000° C. or more. The stabilized fiber bundle as an intermediate material is widely used also as a material for flame-retardant woven fabrics with taking advantage of its flame-retardant properties.

A stabilization process takes the longest treatment time and consumes the largest amount of energy in a process of manufacturing a carbon fiber bundle. Thus, an enhancement in productivity in the stabilization process is most important for manufacturing a carbon fiber bundle.

An apparatus for performing stabilization (hereinafter, referred to as "oxidation oven") generally performs a treatment by shuttling an acrylic fiber in a lateral direction many times and thus stabilizing it, with a direction-changing roller provided outside the oxidation oven, in order to allow for a heat treatment for a long time in the stabilization process. A system that supplies hot air in a substantially horizontal direction to a travelling direction of a fiber bundle is commonly called horizontal flow system, and a system that supplies hot air in a direction perpendicular to a travelling direction of a fiber bundle is commonly called perpendicular flow system. Such horizontal flow systems include an end to end (hereinafter, ETE) hot air system where a supply nozzle of hot air is placed on an end portion of a horizontal flow furnace and a suction nozzle is placed on an opposite end portion thereto, and a center to end (hereinafter, CTE) hot air system where a supply nozzle of hot air is placed on a center section of a horizontal flow furnace and a suction nozzle is placed on each of both end portions thereof.

It is then effective for an enhancement in productivity in the stabilization process to simultaneously convey a large number of fiber bundles and thus increase the density of fiber bundles in the oxidation oven and increase the travelling speed of fiber bundles.

However, in a case where the density of fiber bundles in the oxidation oven is increased, fiber bundle swinging occurs due to the influence of disturbance, for example, the variation in drag received from hot air, and the contact frequency between adjacent fiber bundles is increased. This causes yarn gathering of fiber bundles, single fiber break, and/or the like to frequently occur, thereby leading to, for example, deterioration in quality of stabilized fibers.

In a case where the travelling speed of fiber bundles is increased, the size of the oxidation oven is required to be increased in order to achieve the same amount of heat treating. In particular, in a case where the size in the height direction is increased, there is a need for division of a building floor level into a plurality of levels or a need for an increase in load capacity per floor unit area, thereby leading to an increase in cost of equipment. It is then effective for suppression of such an increase in cost of equipment and an increase in size of the oxidation oven to increase the length per path in the lateral direction (hereinafter, referred to as "oxidation oven length") to thereby decrease the size in the height direction. However, an increase in oxidation oven length results in an increase in amount of suspension of any fiber bundle travelled, and causes not only single fiber break due to the contact with a nozzle, but also the contact between adjacent fiber bundles due to fiber bundle vibration, yarn gathering of fiber bundles, single fiber break, and/or the like to frequently occur as in a case where the density of fiber bundles is increased, thereby leading to, for example, deterioration in quality of stabilized fibers. Accordingly, a problem is that swinging of any fiber bundle travelled in an oxidation oven is required to be reduced even in either a method for an increase in density of fiber bundles or a method for an increase in travelling speed of any fiber bundle, for an enhancement in productivity in a stabilization process.

PATENT LITERATURE

In order to solve the problem, Patent Literature 1 describes a method where an air deflector placed in an oxidation oven of a horizontal flow system can allow hot air to pass over a flat surface of a fiber bundle travelled, to perform a stabilization treatment even at a low air velocity, thereby resulting in a reduction in yarn gathering of adjacent fiber bundles. Patent Literature 2 describes a method where a hot air supply nozzle and a suction nozzle are inclined so as to be horizontal to the locus of a fiber bundle suspended by self-weight, thereby resulting in a reduction in single fiber break due to the contact of the nozzle and the fiber bundle.

Furthermore, Patent Literature 3 describes a method where yarn gathering of adjacent fiber bundles in the case of an elongated oxidation oven length is reduced by allowing the degree of entanglement of a precursor acrylic fiber to be equal to or more than a predetermined value.

Patent Literature 1: JP 2013-542331 A

Patent Literature 2: JP 2004-52128 A

Patent Literature 3: JP H11-61574 A

SUMMARY OF THE INVENTION

However, according to findings of the present inventors, Patent Literature 1 causes flow current turbulence to occur in passing of hot air over a fiber bundle, and thus may cause an increase in fiber bundle swinging even at a low air velocity. An increase in angle of inclination of hot air relative to the flat surface of a fiber bundle travelled may lead to an increase in fiber bundle pitch in a vertical direction of a fiber bundle in the oxidation oven of a horizontal flow system, resulting in an increase in size of the oven by itself and thus an increase in cost of equipment.

Patent Literature 2 cannot allow fiber bundle swinging to be positively controlled, and thus may cause instantly large swinging to occur and cause a fiber bundle to be contacted with any of the nozzles, resulting in the occurrence of yarn break, in the case of the occurrence of disturbance, for example, the variation in tension of a fiber bundle. A structure where the hot air supply nozzle is inclined may lead to an increase in fiber bundle pitch in a vertical direction of a fiber bundle, resulting in an increase in size of an oven by itself and thus an increase in cost of equipment. There is limited to an ETE hot air system of a horizontal flow system, and there cannot be applied to any CTE hot air system excellent in temperature control ability in an oven.

Patent Literature 3 can allow yarn gathering between fiber bundles to be prevented, but an entanglement treatment is assumed to be performed, and thus any fiber bundle may be damaged, resulting in the occurrence of quality loss due to the occurrence of fuzz.

Accordingly, a problem to be solved by the present invention is to provide a method of manufacturing a stabilized fiber bundle and a method of manufacturing a carbon fiber bundle, which can be prevented in quality loss by suppressing fiber bundle swinging in an oven.

Solution to Problem

The method of manufacturing a stabilized fiber bundle of the present invention for solving the above problem has the following configuration, namely, is a method of manufacturing a stabilized fiber bundle, including subjecting an acrylic fiber bundle aligned, to a heat treatment in an oxidizing atmosphere, with the acrylic fiber bundle being turned around by a guide roller placed on each of both ends outside a hot air heating-type oxidation oven, wherein an air velocity Vm of first hot air sent through supply nozzle(s) disposed above and/or under a fiber bundle travelled in the oxidation oven, in a substantially horizontal direction to a travelling direction of the fiber bundle, and an air velocity Vf of second hot air flowing in a fiber bundle passing flow channel in which the fiber bundle is travelled satisfy expression 1).

$$0.2 \leq Vf/Vm \leq 2.0 \quad 1).$$

Herein, the phrase "substantially horizontal direction to a travelling direction of the fiber bundle" in the present invention refers to a direction in a range of ±0.7° with, as a standard, a level line between tips of a pair of opposite direction-changing rollers disposed on both ends outside a heat treatment chamber.

The method of manufacturing a carbon fiber bundle of the present invention has the following configuration, namely, is a method of manufacturing a carbon fiber bundle, including subjecting a stabilized fiber bundle obtained by the method of manufacturing a stabilized fiber bundle, to a precarbonization treatment at a maximum temperature of 300 to 1,000° C. in an inert gas, to obtain a precarbonized fiber bundle, thereafter subjecting the precarbonized fiber bundle to a carbonization treatment at a maximum temperature of 1,000 to 2,000° C. in an inert gas.

Herein, the term "fiber bundle passing flow channel" in the present invention refers to any space which is a space around a fiber bundle, formed along with a travelling direction of a fiber bundle travelled in the oxidation oven, which is a space between a hot air supply nozzle and a hot air supply nozzle that are adjacent in a vertical direction, or which is a space between a hot air supply nozzle and the upper surface of the heat treatment chamber or a space between a hot air supply nozzle and the bottom surface of the heat treatment chamber.

According to the method of manufacturing a stabilized fiber bundle of the present invention, a high-quality stabilized fiber bundle and a high-quality carbon fiber bundle can be produced at a high efficiency without any process troubles by reducing swinging of a fiber bundle travelled in an oxidation oven.

BRIEF DESCRIPTION OF DRAWINGS

FIG. 1 is a schematic cross-sectional view of an oxidation oven for use in a first embodiment of the present invention.

FIG. 2 is a partially enlarged cross-sectional view of the periphery of a hot air supply nozzle for use in the first embodiment of the present invention.

FIG. 3 is a schematic cross-sectional view of an oxidation oven for use in a second embodiment of the present invention.

FIG. 4 is a partially enlarged cross-sectional view of the periphery of a hot air supply nozzle for use in a third embodiment of the present invention.

FIG. 5 is a partially enlarged cross-sectional view of the periphery of a hot air supply nozzle for use in a fourth embodiment of the present invention.

FIG. 6 is a schematic view illustrating a flow current mode on the periphery of a hot air supply nozzle for use in an embodiment of the present invention.

FIG. 7 is a schematic view illustrating a flow current mode on the periphery of a conventional hot air supply nozzle.

FIG. 8 is a schematic view illustrating another flow current mode on the periphery of a conventional hot air supply nozzle.

FIG. 9 is a schematic view of hot air blown out from a supply source of second hot air, in a hot air supply nozzle for use in an embodiment of the present invention.

FIG. 10 is a schematic view of a supply source of second hot air, in a hot air supply nozzle for use in an embodiment of the present invention.

FIG. 11 is a schematic view illustrating a flow current mode on the periphery of a hot air supply port for use in a fifth embodiment of the present invention.

FIG. 12 is a schematic view illustrating a flow current mode on the periphery of a conventional hot air supply port.

DETAILED DESCRIPTION OF EMBODIMENTS OF THE INVENTION

Hereinafter, embodiments of the present invention will be described with reference to FIG. 1 to FIG. 5. The drawings are each a schematic view for accurately expressing the gist of the present invention, such drawings are simplified, an oxidation oven for use in the present invention is not particularly limited, and the dimension and the like thereof can be modified depending on any embodiment.

The present invention provides a method of manufacturing a stabilized fiber bundle, including subjecting an acrylic fiber bundle to a heat treatment in an oxidizing atmosphere, and is carried out in an oxidation oven in which an oxidizing gas flows. As illustrated in FIG. 1, an oxidation oven 1 includes a heat treatment chamber 3 where a stabilization treatment is made by blowing hot air to an acrylic fiber bundle 2 that is traveled with being turned around in a multistage travelling region. The acrylic fiber bundle 2 is sent through an opening (not illustrated) located on a side wall of the heat treatment chamber 3 in the oxidation oven 1, into the heat treatment chamber 3, substantially linearly travelled in the heat treatment chamber 3, and thereafter sent out of the heat treatment chamber 3 through an opening located on an opposite side wall. Thereafter, the acrylic fiber bundle is turned around by each guide roller 4 provided on a side wall out of the heat treatment chamber 3, and again sent into the heat treatment chamber 3. The acrylic fiber bundle 2 is thus turned around multiple times in the travelling direction by such a plurality of guide rollers 4, thus repeatedly sent into and sent out of the heat treatment chamber 3 multiple times, and moved in the heat treatment chamber 3 in a multistage manner as a whole from top to bottom of FIG. 1. The movement direction may be here from bottom to top, and the number of foldings of the acrylic fiber bundle 2 in the heat treatment chamber 3 is not particularly limited and is appropriately designed depending on, for example, the scale of the oxidation oven 1. Such each guide roller 4 may be here provided inside the heat treatment chamber 3.

The acrylic fiber bundle 2, while is turned around and also travelled in the heat treatment chamber 3, is subjected to a stabilization treatment with hot air flowing from a hot air supply nozzle 5 toward a hot air discharge port 7, thereby providing a stabilized fiber bundle. The oxidation oven is an oxidation oven of a CTE hot air system of a horizontal flow system, as described above. The acrylic fiber bundle 2 here has a wide sheet shape where a plurality of fiber bundles are aligned in a parallel manner in a direction perpendicular to a paper surface.

An oxidizing gas flowing in the heat treatment chamber 3 may be, for example, air, and is heated to a desired temperature by a heater 8, thereafter enters the heat treatment chamber 3, and is controlled in air velocity by a blower 9 and also blown through a hot air supply port 6 of the hot air supply nozzle 5 into the heat treatment chamber 3. An oxidizing gas discharged out of the heat treatment chamber 3 through the hot air discharge port 7 of a hot air suction nozzle 14 is subjected to a treatment of a toxic substance with an exhaust gas treatment furnace (not illustrated) and then discharged to the atmosphere, but all the oxidizing gas is not necessarily required to be treated, and the oxidizing gas may be partially untreated, and may pass through a circulation passage and may be again blown through the hot air supply nozzle 5 into the heat treatment chamber 3.

The heater 8 for use in the oxidation oven 1 is not particularly limited as long as it has a desired heating function, and, for example, a known heater such as an electric heater may be used therefor. The blower 9 is also not particularly limited as long as it has a desired blowing function, and, for example, a known blower such as an axial fan may be used therefor.

The rotational speed of each guide roller 4 can be changed to thereby control the travelling speed and the tension of the acrylic fiber bundle 2, which are fixed depending on required physical properties of a stabilized fiber bundle, and the amount of treating per unit time.

A predetermined number of grooves can be engraved on the surface layer of each guide roller 4 at a predetermined interval, or a predetermined number of comb guides (not illustrated) can be placed immediately close to each guide roller 4 at a predetermined interval, thereby controlling the interval and the number of such a plurality of acrylic fiber bundles 2 traveled in parallel.

The amount of production may be enlarged by increasing the number of fiber bundles per unit distance in the width direction of the oxidation oven 1, namely, the yarn density, or increasing the travelling speed of the acrylic fiber bundle 2. On the other hand, in a case where the yarn density is increased, the interval between adjacent fiber bundles is decreased, thereby easily causing deterioration in quality due to yarn gathering of fiber bundles by swinging of fiber bundles, as described above.

In a case where the travelling speed of the acrylic fiber bundle 2 is increased, the residence time in the heat treatment chamber 3 is decreased to cause the amount of heat treating to be insufficient, and thus the total length of the heat treatment is required to be increased. Such a need for an increase in total length may be satisfied by increasing the height of the oxidation oven 1 and thus increasing the number of turnings of the acrylic fiber bundle, or increasing the length L per path of the oxidation oven (hereinafter, "oxidation oven length"), and it is preferable for suppression of the cost of equipment to increase the oxidation oven length L. However, the lateral length L' between the guide rollers 4 is also increased to easily cause any fiber bundle to be suspended, easily causing, for example, deterioration in quality due to the contact between fiber bundles and yarn gathering of fiber bundles by swinging to occur. Such swinging is due to the influence of disturbance, such as any variation in drag where the acrylic fiber bundle 2 travelled is received from hot air, and it is common for a decrease in the influence of disturbance to uniform the air velocity of hot air flowing in the heat treatment chamber 3. For example, the hot air supply nozzle 5 is preferably provided with a resistor such as a porous plate and a rectification member such as a honeycomb (both are not illustrated) to thereby have pressure loss. The rectification member can rectify hot air blown into the heat treatment chamber 3 and blow hot air at a more uniform air velocity, into the heat treatment chamber 3.

However, the present inventors have found that only a decrease in variation in air velocity of hot air supplied from the hot air supply port 6 of the hot air supply nozzle 5 cannot suppress disturbance locally occurring by hot air supplied into the heat treatment chamber 3 and makes it difficult to decrease swinging of fiber bundles, important for an enhancement in production efficiency of a stabilized fiber bundle.

There have been made intensive studies about the above problems, and the method of manufacturing a stabilized fiber bundle of the present invention efficiently produces a high-quality stabilized fiber without any process troubles. Hereinafter, a principle for enabling deterioration in quality to be prevented by suppression of swinging of fiber bundles, as a most important point for the present invention, will be described in detail.

First, the velocity vector in the case of use of a hot air supply nozzle 5 configured according to the prior art is described with reference to FIG. 7 and FIG. 8 in order to clarify the difference between the prior art and the present invention. FIG. 7 illustrates a case of a method of manufacturing a stabilized fiber bundle, including subjecting an acrylic fiber bundle 2 aligned, to a heat treatment, with the acrylic fiber bundle being travelled in a hot air heating-type oxidation oven 1, in which the air velocity Vm of first hot air sent through hot air supply nozzle(s) 5 disposed above and/or under the acrylic fiber bundle 2 travelled in the oxidation oven 1, in a substantially horizontal direction to a travelling direction of a fiber bundle, and the air velocity Vf of second hot air flowing in a fiber bundle passing flow channel 10 in which the fiber bundle is travelled are not particularly controlled, and the second air velocity Vf is much lower than the air velocity Vm of the first hot air (Vf<<Vm) on a confluent face 13 serving as a location where the second hot air and the first hot air are joined. In this case, the difference in velocity between the first hot air and the second hot air is generated on the confluent face 13, the first hot air entrains the second hot air to thereby form a vortex, increasing swinging of the acrylic fiber bundle 2. FIG. 8 illustrates a case where the second air velocity Vf is much higher than the air velocity Vm of first hot air (Vf>>Vm) on a confluent face 13 serving as a location where the second hot air and the first hot air are joined, and the difference in velocity between the first hot air and the second hot air is generated on the confluent face 13 and the second hot air entrains the first hot air to thereby form a vortex, increasing swinging of the acrylic fiber bundle 2, as in the case illustrated in FIG. 7. Furthermore, an increase in air velocity Vn in supplying of the second hot air from the supply source causes flow current disturbance to occur in the fiber bundle passing flow channel 10, thereby increasing swinging of the acrylic fiber bundle 2.

On the contrary, an embodiment (first embodiment) of the present invention provides, as illustrated in FIG. 2, a method of manufacturing a stabilized fiber bundle, including subjecting an acrylic fiber bundle 2 aligned, to a heat treatment in an oxidizing atmosphere, with the acrylic fiber bundle being turned around by a guide roller 4 placed on each of both ends outside a hot air heating-type oxidation oven 1, wherein the air velocity Vm of first hot air sent through hot air supply nozzle(s) 5 disposed above and/or under the acrylic fiber bundle 2 travelled in the oxidation oven, in a substantially horizontal direction to a travelling direction of the acrylic fiber bundle 2, and the air velocity Vf of second hot air flowing in a fiber bundle passing flow channel 10 in which the fiber bundle is travelled are set to satisfy expression 1).

$$0.2 \leq Vf/Vm \leq 2.0 \qquad 1).$$

The fiber bundle passing flow channel 10 here mentioned refers to any space which is a space around the fiber bundle, formed along with a travelling direction of the acrylic fiber bundle 2 travelled in the oxidation oven 1, which is a space between a hot air supply nozzle 5 and a hot air supply nozzle 5 which are adjacent in a vertical direction, or which is a space between a hot air supply nozzle 5 and the upper surface of the heat treatment chamber 3 or a space between a hot air supply nozzle 5 and the bottom surface of the heat treatment chamber 3.

FIG. 6 illustrates the velocity vector of hot air in the case of use of the hot air supply nozzle 5 in the present invention. It is characterized in that a confluent mode on the confluent face 13 serving as a location where the first hot air and the second hot air are joined is controlled at a high accuracy, unlike the prior art. In this case, it is possible to suppress the occurrence of any vortex due to the difference in velocity, which has been problematic in the prior art and which is generated on the confluent face 13 of the first hot air and the second hot air at Vf<<Vm or Vf>>Vm, and thus fiber bundle swinging can be decreased. Furthermore, the air velocity Vn in supplying of the second hot air from the supply source is in a proper range, and thus flow current turbulence in the fiber bundle passing flow channel 10 can be suppressed and fiber bundle swinging can be decreased. In particular, the CTE hot air system, in which the supply nozzle 5 is disposed at the center of the guide roller 4, allows the amount of suspension of the acrylic fiber bundle 2 to be maximized and it is thus expected that fiber bundle swinging is maximized over the oxidation oven length, whereas swinging of the acrylic fiber bundle 2 can be here decreased. That is, it is extremely important that the stabilization method in the present invention is in a condition where a relationship between the air velocity Vm of the first hot air and the air velocity Vf of the second hot air flowing in the fiber bundle passing flow channel 10 where the fiber bundle is travelled, which has not been considered in the prior art at all, satisfy the expression 1).

Furthermore, the air velocity Vm of the first hot air and the air velocity Vf of the second hot air preferably satisfy expression 2) in order to minimize swinging of the acrylic fiber bundle 2.

$$0.2 \leq Vf/Vm \leq 0.9 \qquad 2).$$

Thus, the influence of disturbance of any flow current occurring in the fiber bundle passing flow channel 10 can be minimized, resulting in an enhancement in production efficiency.

There are two methods of adjusting the air velocity Vf of the second hot air, and a first method is a method of adjusting the volumetric flow rate of the second hot air sent from a supply source 11 of the second hot air and a second method is a method of adjusting the distance H between supply nozzles in the fiber bundle passing flow channel 10. A too small distance H between nozzles may cause the acrylic fiber bundle 2 suspended and the supply nozzles to be contacted, resulting in the occurrence of single fiber break. A too large distance H between nozzles leads to an increase in size in the height direction of the oxidation oven 1. This leads to a need for division of a building floor level into a plurality of levels and a need for an increase in load capacity per floor unit area, thereby leading to an increase in cost of equipment. In addition, a too large distance H between nozzles leads to a need for a large amount of supply of hot air in order to maintain the air velocity Vf of the second hot air to a certain value, and thus the size of a fan is increased, thereby leading to an increase in cost of equipment. Accordingly, the air velocity Vf of the second hot air is preferably adjusted by the first method of adjusting the volumetric flow rate of hot air sent from the supply source 11 of the second hot air.

The air velocity Vn in supplying of the second hot air from the supply source is preferably 0.5 m/s or more and 15 m/s or less. The air velocity Vn of the hot air may be adjusted by adjusting the opening area of the supply source 11. Thus, the influence of disturbance occurring in the fiber bundle passing flow channel 10 can be decreased, and thus a further enhancement in production efficiency can be expected.

Next, a second embodiment of the method of manufacturing a stabilized fiber bundle of the present invention is illustrated in FIG. 3. In the second embodiment, an ETE hot air system may also be adopted where a supply nozzle is placed on an end portion of an oxidation oven. In this case, the amount of swinging of an acrylic fiber bundle 2, by itself, is smaller than that in the CTE hot air system, whereas the effective oven length is increased to thereby allow the effects of the present invention to be more remarkably exerted.

Next, a third embodiment of the method of manufacturing a stabilized fiber bundle of the present invention is described with reference to FIG. 4. An auxiliary supply surface 12 that supplies the second hot air through the hot air supply nozzle 5 may be disposed above and under the fiber bundle passing flow channel 10. In this case, the air velocity can be decreased by half at the same air volume supplied to the fiber bundle passing flow channel 10, thereby reducing flow current disturbance around the acrylic fiber bundle 2, as compared with a case where the auxiliary supply surface 12 is placed at any one of the upper or lower side of the fiber bundle passing flow channel 10.

The auxiliary supply surface 12 that supplies the second hot air is more preferably disposed only above the fiber bundle travelled, and thus the effect of reducing further fiber bundle swinging can be expected. In a case where the auxiliary supply surface is present under the acrylic fiber bundle 2 travelled, hot air is applied to the fiber bundle in a direction opposite to a direction of the gravity by which the fiber bundle is suspended, resulting in the occurrence of drag and thus an increase in variation of tension, but the auxiliary supply surface can be present above the fiber bundle and drag can be in the same direction as that of the gravity, resulting in a decrease in variation of tension, and the effect of reducing fiber bundle swinging can be expected.

Next, a fourth embodiment of the method of manufacturing a stabilized fiber bundle of the present invention is described with reference to FIG. 5. The supply source 11 of the second hot air may be a new auxiliary supply nozzle different from the hot air supply nozzle 5, in the fiber bundle passing flow channel 10. In this case, such a nozzle is controlled separately from the hot air supply nozzle 5, and thus the air velocity, the direction of air, and the temperature of hot air are easily controlled. On the other hand, there are concerns about an increase in equipment cost and the contact of the auxiliary supply nozzle and the fiber bundle due to a narrower fiber bundle passing flow channel 10, and thus the supply source of the first hot air and the supply source of the second hot air are more preferably the same supply sources as in the first embodiment.

In a case where the supply source of the first hot air and the supply source of the second hot air in the present invention are the same, a supply face of the second hot air blown through the hot air supply nozzle 5 may be one portion or the entire surface of the bottom surface and the upper surface of the hot air supply nozzle 5, as illustrated in FIG. 9, or may be a surface opposite to the first hot air supply port 6.

In a case where the supply source of the first hot air and the supply source of the second hot air in the present invention are different, the supply source of the second hot air may be placed above or under the fiber bundle passing flow channel 10, as illustrated in FIG. 10, or may be a surface opposite to the first hot air supply port 6. The direction of any air supplied may be horizontal or perpendicular to that of the first hot air, or such any air may be blown out in a plurality of directions.

Next, a fifth embodiment of the method of manufacturing a stabilized fiber bundle of the present invention is illustrated in FIG. 11. A rectifying plate 16 that partitions a space downstream of the hot air supply port 6 and the fiber bundle passing flow channel may be disposed to allow the location of the confluent face 13 of the first hot air and the second hot air to be displaced downstream of the hot air supply port 6. In general, the hot air supply port 6 includes a rectification member for sealing one portion of the flow channel, such as a punching metal or a honeycomb, for the purpose of making the air velocity of hot air flowing in the heat treatment chamber 3, uniform. The prior art here has caused hot air to be sent through only an opening of a rectification member and to be tried to flow with drawing any flow current in a sealed unit, thereby forming a vortex serving as flow current turbulence, near the sealed unit, as illustrated in FIG. 12. The flow current disturbance is transmitted to the second hot air on the confluent face 13 to thereby cause any flow current around the acrylic fiber bundle 2 to be disturbed, thereby increasing fiber bundle swinging.

On the contrary, in a case where the rectifying plate 16 is provided as illustrated in FIG. 11, flow current turbulence occurring after passing through the hot air supply port 6 is homogenized and then reaches the confluent face 13, and thus such flow current turbulence on the confluent face is reduced.

The distance S from the hot air supply port to the confluent face, which is necessary for allowing the flow current turbulence to be homogenized, depends on the aperture ratio of the rectification member disposed, and the air velocity, and is 20 mm or more, preferably 300 mm or less according to studies of the present inventors. While the rectifying plate is used in the present embodiment, any rectification member may be used as long as the confluent face 13 is positioned downstream of the hot air supply port 6, and the effect thereof is not changed at all.

The single fiber fineness in the acrylic fiber bundle in the method of manufacturing a stabilized fiber bundle of the present invention is preferably 0.05 to 0.22 tex, more preferably 0.05 to 0.17 tex. Such a preferable range not only hardly causes a single fiber to tangle in the contact between adjacent fiber bundles and can effectively prevent yarn gathering between fiber bundles, but also can allow heat to be sufficiently spread to the interior layer of a single fiber in the oxidation oven and can hardly cause fiber bundle fuzzing and effectively prevent large yarn gathering, thereby leading to more excellent quality and process stability of a stabilized fiber bundle.

A stabilized fiber bundle manufactured by the above method is subjected to a precarbonization treatment at a maximum temperature of 300 to 1000° C. in an inert gas, thereby manufacturing a precarbonized fiber bundle, and the precarbonized fiber bundle is subjected to a carbonization treatment at a maximum temperature of 1,000 to 2,000° C. in an inert gas, thereby manufacturing a carbon fiber bundle.

The maximum temperature in the inert gas in the precarbonization treatment is preferably 550 to 800° C. Any known inert gas such as nitrogen, argon, or helium can be adopted as the inert gas with which a precarbonization furnace is filled, and nitrogen is preferable in terms of economic efficiency.

A precarbonized fiber obtained by the precarbonization treatment is then sent into a carbonization furnace and subjected to a carbonization treatment. The carbonization treatment is preferably performed at a maximum temperature of 1,200 to 2,000° C. in an inert gas in order to enhance mechanical properties of a carbon fiber.

Any known inert gas such as nitrogen, argon, or helium can be adopted as the inert gas with which the carbonization furnace is filled, and nitrogen is preferable in terms of economic efficiency.

A sizing agent may be given to a carbon fiber bundle thus obtained, in order to enhance handleability, and affinity with a matrix resin. The type of the sizing agent is not particularly limited as long as desired characteristics can be obtained, and examples include any sizing agent containing an epoxy resin, a polyether resin, an epoxy-modified polyurethane resin, or a polyester resin, as a main component. A known method can be used for providing the sizing agent.

The carbon fiber bundle may be, if necessary, subjected to an electrolytic oxidation treatment or an oxidation treatment for the purpose of enhancements in affinity with and adhesiveness to a fiber-reinforced composite material matrix resin.

An acrylic fiber bundle for use as a fiber bundle to be subjected to a heat treatment in the method of manufacturing a stabilized fiber bundle of the present invention suitably includes an acrylic fiber containing 100% of acrylonitrile, or an acrylic copolymer fiber containing 90% by mol or more of acrylonitrile. Examples of a preferable copolymerizable component in the acrylic copolymer fiber include acrylic acid, methacrylic acid, itaconic acid, and any alkali metal salt and any ammonium metal salt thereof, acrylamide, and methyl acrylate, and the acrylic fiber bundle is not particularly limited in terms of, for example, chemical characteristics, physical characteristics, and the dimension.

EXAMPLES

Hereinafter, the present invention will be more specifically described by Examples with reference to the drawings, but the present invention is not limited thereto. The air velocity and the amount of yarn swinging measured in Examples and Comparative Examples were each determined by any method described below.

(1) Method of Measuring of Single Fiber Fineness of Acrylic Fiber Bundle

Any fiber bundle before sending into an oxidation oven was collected, and measurement was performed according to JIS L 1013.

(2) Method of Measuring of Air Velocity

An air speedometer for use at high temperatures, an anemomaster Model 6162 manufactured by KANOMAX JAPAN INC., was used, and the average value of measurement values at 30 points with respect to one second was adopted. A measurement probe was inserted through a measurement hole (not illustrated) on a side surface of a heat treatment chamber 3, and measurement was performed under the assumption that the average value of the measurement values at 3 points in the width direction, including the center in the width direction, in a hot air supply port 6 was Vm, the average value of the measurement values at 3 points in the width direction, including the center in the width direction, on a line where a confluent face 13 of first hot air and second hot air was crossed with fiber bundles was Vf, and the average value of the measurement values at 3 points in the width direction, including the center in the width direction, in a supply source 11 of second hot air was Vn.

(3) Method of Measuring Amplitude of Vibration of Fiber Bundles

Measurement was performed at a position corresponding to the center of a guide roller 4 on each of both sides of an oxidation oven 1, where the maximum amplitude of vibration of fiber bundles travelled was obtained. Specifically, a laser displacement meter LJ-G200 manufactured by KEYENCE CORPORATION was placed on an upper or lower portion of fiber bundles travelled, and a specified fiber bundle was irradiated with laser. The distance between both ends in the width direction of such a fiber bundle was defined as the width of fiber bundle, and the amount of variation in the width direction at one end in the width direction was defined as the amplitude of vibration. These were each measured at a frequency of once/60 seconds or more and an accuracy of 0.01 mm or less for 5 minutes, the average value Wy with respect to the width of the fiber bundle and the standard deviation a of the amplitude of vibration were acquired, and the contact probability P between adjacent fiber bundles, defined by the following expression, was calculated.

$$P=[1-p(x)\{-t<x<t\}]\times 100$$

Herein, P represents the contact probability (%) between adjacent fiber bundles, p(x) represents the probability density function of a normal distribution N(0, σ2), and x represents the random variable under the assumption that the center of yarn swinging is zero. In addition, t represents the interspace (mm) between adjacent fiber bundles, and can be represented by the following expression.

$$t=(Wp-Wy)/2$$

Herein, Wp represents the pitch interval physically regulated by the guide roller or the like, and Wy represents the width of any fiber bundle travelled.

The "contact probability P between adjacent fiber bundles" in the present invention here refers to a probability where, when a plurality of fiber bundles are laid in parallel so as to be adjacent, and are travelled, the interspace between adjacent fiber bundles is zero due to vibration in the width direction of fiber bundles. The amplitude of vibration in the width direction of fiber bundles is assumed to be according to the normal distribution N, when the average amplitude of vibration of fiber bundles is 0 and the standard deviation of the amplitude of vibration is a.

The evaluation criteria of process stability and quality in Examples and Comparative Examples were each as follows.

(Process Stability)

Excellent: troubles such as yarn gathering and fiber bundle break occurred zero times per day on average, and process stability was at an extremely favorable level.

Good: troubles such as yarn gathering and fiber bundle break occurred about several times per day on average, and process stability was at a level where continuous running could be sufficiently continued.

Unacceptable: troubles such as yarn gathering and fiber bundle break occurred several ten times per day on average, and process stability was at a level where continuous running could not be continued.

(Product Quality)

Excellent: the number of pieces of fuzz of 10 mm or more on fiber bundles, which could be visually confirmed after the stabilization process, was several pieces/m or less on average, and was at a level where fuzz quality did not have any effect on process passability and high-order processability of a product, at all.

Good: the number of pieces of fuzz of 10 mm or more on fiber bundles, which could be visually confirmed after the stabilization process, was 10 pieces/m or less on average, and was at a level where fuzz quality did almost not have any effect on process passability and high-order processability of a product.

Unacceptable: the number of pieces of fuzz of 10 mm or more on fiber bundles, which could be visually confirmed after the stabilization process, was several ten pieces/m or more on average, and was at a level where fuzz quality had any adverse effect on process passability and high-order processability of a product.

Example 1

FIG. 1 is a schematic configuration view illustrating one example of a case where a heat treatment furnace in the present invention is used as an oxidation oven for manufacturing a carbon fiber. Respective hot air supply nozzles 5 serving as supply sources of first and second hot air are placed at the centers of guide rollers 4 on both sides of an oxidation oven 1, upward and downward with an acrylic fiber bundle 2 travelled in the oxidation oven 1 being sandwiched. Such each hot air supply nozzle 5 is provided with a hot air supply port 6 for supplying the first hot air and an auxiliary supply surface 12 for supplying the second hot air on an upper surface of such each hot air supply nozzle 5 in a travelling direction of fiber bundles or in a direction opposite to the travelling direction of fiber bundles. The hot air supply port 6 and the auxiliary supply surface 12 are each provided with a porous plate having an aperture ratio of 30% so that the air velocity in the width direction is uniform.

A stabilized fiber bundle was obtained by aligning 100 fiber bundles as acrylic fiber bundles 2 travelled in the oven, each made of 20,000 single fibers each having a single fiber fineness of 0.11 tex, and subjecting the resultant to a heat treatment in the oxidation oven 1. The lateral length L' between the guide rollers 4 on both sides of the heat treatment chamber 3 of the oxidation oven 1 was 15 m, the guide rollers 4 were each a groove roller, and the pitch interval Wp was 8 mm. The temperature of an oxidizing gas in the heat treatment chamber 3 of the oxidation oven 1 was here 240 to 280° C., and the air velocity in the lateral direction of the oxidizing gas was 6 m/s. The fiber bundle travelling speed was adjusted in the range from 1 to 15 m/minute according to the oxidation oven length L so that the stabilization treatment time was sufficiently taken, and the process tension was adjusted in the range from 0.5 to 2.5 g/tex.

The stabilized fiber bundle was thereafter carbonized in a precarbonization furnace at a maximum temperature of 700° C., thereafter carbonized in a carbonization furnace at a maximum temperature of 1,400° C., and subjected to an electrochemical treatment of fiber surface and coated with a sizing agent, thereby providing a carbon fiber bundle.

The width Wy and the standard deviation a of the amplitude of vibration, of fiber bundles travelled in the uppermost stage in the heat treatment chamber 3 of the oxidation oven 1, were actually measured at the center of the heat treatment chamber. The results were as described in Table 1, and in a case where Vf/Vm=1.5 was adopted and the air velocity on the auxiliary supply surface 12 was 16.0 m/s, the contact probability P between adjacent fiber bundles, statistically calculated, was 16.4%. There were less caused yarn gathering, fiber bundle break, and the like due to the contact between fiber bundles in the stabilization treatment of the acrylic fiber bundles in the above conditions, and a stabilized fiber bundle was obtained at favorable process stability. The resulting stabilized fiber bundle and carbon fiber bundle were visually confirmed, and as a result, had less fuzz and the like and were favorable in quality.

Example 2

The same manner as in Example 1 was performed except that the air velocity on the auxiliary supply surface 12 was 2.8 m/s. The contact probability P between adjacent fiber bundles, here statistically calculated, was 10.3%. There were not caused any yarn gathering, fiber bundle break, and the like due to the contact between fiber bundles at all, in the stabilization treatment of the acrylic fiber bundles in the above conditions, and a stabilized fiber bundle was obtained at extremely favorable process stability. The resulting stabilized fiber bundle and carbon fiber bundle were visually confirmed, and as a result, had no fuzz and the like and were extremely favorable in quality.

Example 3

The same manner as in Example 2 was performed except that the auxiliary supply surface 12 was provided not on an upper surface of the hot air supply nozzle 5, but on a lower surface thereof. The contact probability P between adjacent fiber bundles, here statistically calculated, was 5.6%. There were not caused any yarn gathering, fiber bundle break, and the like due to the contact between fiber bundles at all, in the stabilization treatment of the acrylic fiber bundles in the above conditions, and a stabilized fiber bundle was obtained at extremely favorable process stability. The resulting stabilized fiber bundle and carbon fiber bundle were visually confirmed, and as a result, had no fuzz and the like and were extremely favorable in quality.

Example 4

The same manner as in Example 3 was performed except that Vf/Vm=0.7 was satisfied. The contact probability P between adjacent fiber bundles, here statistically calculated, was 3.1%. There were not caused any yarn gathering, fiber bundle break, and the like due to the contact between fiber bundles at all, in the stabilization treatment of the acrylic fiber bundles in the above conditions, and a stabilized fiber bundle was obtained at extremely favorable process stability. The resulting stabilized fiber bundle and carbon fiber bundle were visually confirmed, and as a result, had no fuzz and the like and were extremely favorable in quality.

Example 5

The same manner as in Examples 3 and 4 was performed except that Vf/Vm=0.5 was satisfied. The contact probability P between adjacent fiber bundles, here statistically calculated, was 0.1%. There were not caused any yarn gathering, fiber bundle break, and the like due to the contact between fiber bundles at all, in the stabilization treatment of the acrylic fiber bundles in the above conditions, and a stabilized fiber bundle was obtained at extremely favorable process stability. The resulting stabilized fiber bundle and carbon fiber bundle were visually confirmed, and as a result, had no fuzz and the like and were extremely favorable in quality.

Example 6

The same manner as in Examples 3, 4 and 5 was performed except that Vf/Vm=0.25 was satisfied. The contact probability P between adjacent fiber bundles, here statistically calculated, was 1.0%. There were not caused any yarn gathering, fiber bundle break, and the like due to the contact between fiber bundles at all, in the stabilization treatment of the acrylic fiber bundles in the above conditions, and a stabilized fiber bundle was obtained at extremely favorable process stability. The resulting stabilized fiber bundle and carbon fiber bundle were visually confirmed, and as a result, had no fuzz and the like and were extremely favorable in quality.

Example 7

The same manner as in Example 3 was performed except that a rectifying plate was disposed downstream of the hot air supply port 6 and the distance S from the hot air supply port to the confluent face 13 was 100 mm. The contact probability P between adjacent fiber bundles, here statistically calculated, was 2.2%. There were not caused any yarn gathering, fiber bundle break, and the like due to the contact between fiber bundles at all, in the stabilization treatment of the acrylic fiber bundles in the above conditions, and a stabilized fiber bundle was obtained at extremely favorable process stability. The resulting stabilized fiber bundle and carbon fiber bundle were visually confirmed, and as a result, had no fuzz and the like and were extremely favorable in quality.

Comparative Example 1

The same manner as in Example 1 was adopted except that Vf/Vm=2.5 was adopted and the air velocity on the auxiliary supply surface 12 was 15.0 m/s in Comparative Example 1. The contact probability P between adjacent fiber bundles, here statistically calculated, was 21.2%, and there was considerably caused yarn gathering and single fiber break due to the contact between fiber bundles in the stabilization treatment of the fiber bundle. The resulting stabilized fiber bundle and carbon fiber bundle were visually confirmed, and as a result, considerably had fuzz and the like and were inferior in quality.

Comparative Example 2

The auxiliary supply surface 12 was clogged and Vf/Vm=0.0 was adopted in Comparative Example 2, and the amplitude of vibration of fiber bundles was actually measured. The contact probability P between adjacent fiber bundles, here statistically calculated, was 20.7%, and there was considerably caused yarn gathering and single fiber break due to the contact between fiber bundles in the stabilization treatment of the fiber bundle. The resulting stabilized fiber bundle and carbon fiber bundle were visually confirmed, and as a result,

| | | Example 1 | Example 2 | Example 3 | Example 4 | Example 5 | Example 6 | Example 7 | Comparative Example 1 | Comparative Example 2 |
|---|---|---|---|---|---|---|---|---|---|---|
| Equipment Conditions | Roll Span [m] | 15.0 | 15.0 | 15.0 | 15.0 | 15.0 | 15.0 | 15.0 | 15.0 | 15.0 |
| | Groove Pitch [mm] | 8.0 | 8.0 | 8.0 | 8.0 | 8.0 | 8.0 | 8.0 | 8.0 | 8.0 |
| Vt/Vm[—] | | 1.5 | 1.5 | 1.5 | 0.7 | 0.5 | 0.25 | 1.5 | 2.5 | 0.0 |
| First Hot Air | Vm [m/s] | 6.0 | 6.0 | 6.0 | 6.0 | 6.0 | 6.0 | 6.0 | 6.0 | 6.0 |
| Second Hot Air | Vf [m/s] | 9.0 | 9.0 | 9.0 | 4.2 | 3.0 | 1.5 | 9.0 | 15.0 | 0.0 |
| | Supply Source | First Hot Air Nozzle | First Hot Air Nozzle | First Hot Air Nozzle | First Hot Air Nozzle | First Hot Air Nozzle | First Hot Air Nozzle | First Hot Air Nozzle | First Hot Air Nozzle | First Hot Air Nozzle |
| | Location of Supply Source | under the Fiber Bundle | under the Fiber Bundle | above the Fiber Bundle | above the Fiber Bundle | above the Fiber Bundle | above the Fiber Bundle | above the Fiber Bundle | under the Fiber Bundle | — |
| | Vn [m/s] | 16.0 | 2.8 | 2.8 | 2.8 | 2.8 | 2.8 | 2.8 | 15.3 | 0.0 |
| Contact Probability P [%] | | 16.4 | 10.3 | 5.6 | 3.1 | 0.1 | 1.0 | 2.2 | 21.2 | 20.7 |
| Distance from Hot Air Supply Port to Confluent Face S [mm] | | 0.0 | 0.0 | 0.0 | 0.0 | 0.0 | 0.0 | 100.0 | 0.0 | 0.0 |
| Process Stability | | good | excellent | excellent | excellent | excellent | excellent | excellent | failure | failure |
| Product Quality | | good | excellent | excellent | excellent | excellent | excellent | excellent | failure | failure |

INDUSTRIAL APPLICABILITY

The present invention relates to a method of manufacturing a stabilized fiber bundle and a method of manufacturing a carbon fiber bundle, and can be applied in aerospace applications, industrial applications such as pressure containers and windmills, sports applications such as golf shafts, and/or the like, but the application scope thereof is not limited thereto.

REFERENCE SIGNS LIST

1 oxidation oven
2 acrylic fiber bundle
3 heat treatment chamber
4 guide roller
5 hot air supply nozzle
6 hot air supply port
7 hot air discharge port
8 heater
9 blower
10 fiber bundle passing flow channel
11 supply source of second hot air
12 auxiliary supply surface
13 confluent face
14 hot air suction nozzle
15 supply source of first hot air
16 rectifying plate
L oxidation oven length (effective length of stabilization in one path)
L' lateral length between guide rollers
H distance between nozzles
Wp pitch interval physically regulated
Wy width of fiber bundle travelled
t interspace between adjacent fiber bundles
S distance from hot air supply port to confluent face

The invention claimed is:

1. A method of manufacturing a stabilized fiber bundle, comprising subjecting an aligned acrylic fiber bundle to a heat treatment in an oxidizing atmosphere, with the acrylic fiber bundle being turned around by a guide roller placed on each of both ends of the fiber bundle outside a hot air heating-type oxidation oven containing a plurality of supply nozzles, wherein inside the oxidation oven a velocity Vm of first hot air sent through a first supply nozzle disposed above and/or under the fiber bundle in a substantially horizontal direction relative to a direction traveled by the fiber bundle as it is being turned around, and a velocity Vf of second hot air flowing in a fiber bundle passing flow channel existing between the first supply nozzle and a second supply nozzle, the second hot air also flowing in a substantially horizontal direction relative to the direction traveled by the fiber bundle satisfy expression 1), where the second hot air originates as air of velocity Vn from the first and/or the second supply nozzles before flowing in the fiber bundle passing flow channel as the second hot air of velocity Vf and joining with the first hot air of velocity Vm $$0.2 \leq Vf/Vm \leq 2.0 \quad 1); \text{ and}$$

wherein a single fiber fineness in the acrylic fiber bundle before the heat treatment is 0.05 to 0.22 tex.

2. The method of manufacturing a stabilized fiber bundle according to claim 1, wherein the air velocity Vn of the second hot air from a supply source of the second hot air is in a range of 0.5 m/s or more and 15 m/s or less.

3. The method of manufacturing a stabilized fiber bundle according to claim 2, wherein the supply source of the second hot air is present only above the fiber bundle passing flow channel.

4. The method of manufacturing a stabilized fiber bundle according to claim 1, wherein a supply source of the first hot air and a supply source of the second hot air are the same source.

5. The method of manufacturing a stabilized fiber bundle according to claim 1, wherein the first supply nozzle is disposed in a center of the oxidation oven in a substantially horizontal direction relative to the direction traveled by the fiber bundle, and supplies the first hot air in a direction toward both ends in the oxidation oven.

6. The method of manufacturing a stabilized fiber bundle according to claim 1, wherein a confluent face of the first hot air and the second hot air is located downstream of the first supply nozzle.

7. A method of manufacturing a carbon fiber bundle, comprising subjecting a stabilized fiber bundle obtained by the method of manufacturing a stabilized fiber bundle according to claim 1, to a precarbonization treatment at a maximum temperature of 300 to 1,000° C. in an inert gas, to obtain a precarbonized fiber bundle, and thereafter subjecting the precarbonized fiber bundle to a carbonization treatment at a maximum temperature of 1,000 to 2,000° C. in an inert gas.

* * * * *